US010591173B2

(12) United States Patent
Denton

(10) Patent No.: US 10,591,173 B2
(45) Date of Patent: Mar. 17, 2020

(54) DEFROST LEARNING ALGORITHM BASED ON TIME OF DEFROST STATE OPERATION

(71) Applicant: Trane International Inc., Piscataway, NJ (US)

(72) Inventor: Darryl Elliott Denton, Tyler, TX (US)

(73) Assignee: Trane International Inc., Piscataway, NJ (US)

( * ) Notice: Subject to any disclaimer, the term of this patent is extended or adjusted under 35 U.S.C. 154(b) by 1064 days.

(21) Appl. No.: 14/991,673

(22) Filed: Jan. 8, 2016

(65) Prior Publication Data

US 2016/0238301 A1 Aug. 18, 2016

Related U.S. Application Data

(60) Provisional application No. 62/116,187, filed on Feb. 13, 2015.

(51) Int. Cl.

| | |
|---|---|
| ***F24F 11/41*** | (2018.01) |
| ***F24F 11/42*** | (2018.01) |
| ***F25D 21/00*** | (2006.01) |
| ***F24F 11/30*** | (2018.01) |

(52) U.S. Cl.

CPC ..... *F24F 11/30* (2018.01); *F24F 11/42* (2018.01)

(58) Field of Classification Search

CPC ..... F24F 11/41; F24F 11/42; F25B 2700/11; F25B 2700/2117; F25D 21/00

See application file for complete search history.

(56) References Cited

U.S. PATENT DOCUMENTS

| | | | | |
|---|---|---|---|---|
| 4,882,908 A * | 11/1989 | White | F25B 13/00 62/155 |
| 5,179,841 A * | 1/1993 | Phillips | F25D 21/006 62/155 |
| 6,318,095 B1 * | 11/2001 | Guo | F25B 47/025 62/80 |
| 2015/0047375 A1 * | 2/2015 | Qu | F25D 21/004 62/80 |

* cited by examiner

*Primary Examiner* — Frantz F Jules
*Assistant Examiner* — Erik Mendoza-Wilkenfel
(74) *Attorney, Agent, or Firm* — Conley Rose, P.C.; Kristian R. Sullivan; J. Robert Brown, Jr.

(57) ABSTRACT

Systems and methods are disclosed that include providing a heating, ventilation, and/or air conditioning (HVAC) system with a controller that may adjust the defrost procedure algorithm by monitor the refrigeration coil temperature sensor and the ambient outdoor temperature sensor, calculate an Actual Coil Delta Temperature (ACDT); compare the calculated ACDT to an Initiate Delta Temperature (DTINIT) associated with the measured ambient outdoor temperature; initiate a defrost procedure in response to the calculated ACDT being greater than or equal to the DTINIT; determine if the duration of the defrost procedure is within a predetermined time threshold; and adjust the duration of a next defrost procedure in response to determining that a predetermined number of consecutive defrost procedures have occurred outside of the predetermined time threshold.

20 Claims, 8 Drawing Sheets

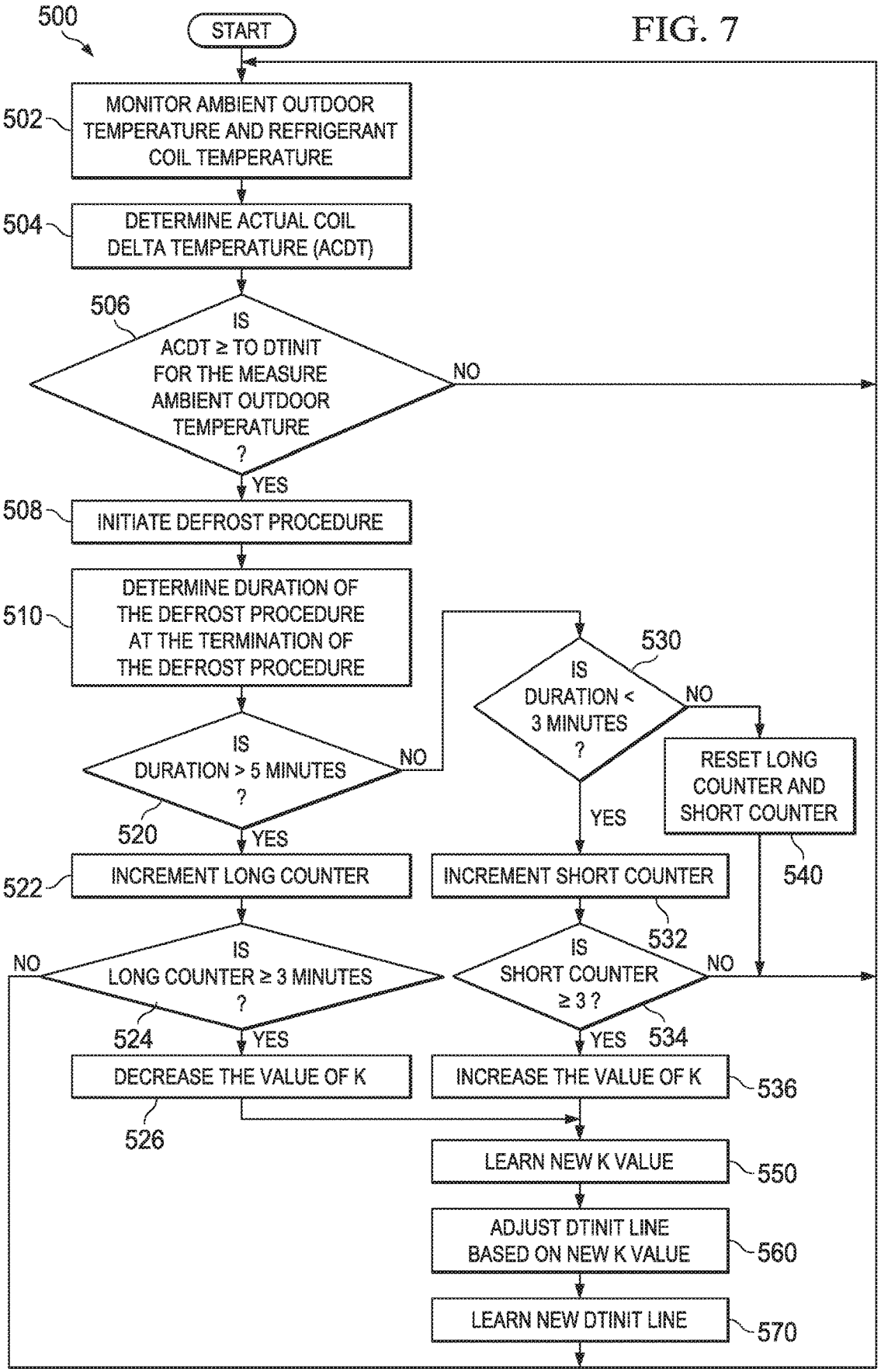
500
START
FIG. 7
502
MONITOR AMBIENT OUTDOOR TEMPERATURE AND REFRIGERANT COIL TEMPERATURE
504
DETERMINE ACTUAL COIL DELTA TEMPERATURE (ACDT)
506
IS ACDT ≥ TO DTINIT FOR THE MEASURE AMBIENT OUTDOOR TEMPERATURE ?
NO
YES
508
INITIATE DEFROST PROCEDURE
510
DETERMINE DURATION OF THE DEFROST PROCEDURE AT THE TERMINATION OF THE DEFROST PROCEDURE
IS DURATION > 5 MINUTES ?
NO
YES
520
522
INCREMENT LONG COUNTER
IS LONG COUNTER ≥ 3 MINUTES ?
NO
YES
524
DECREASE THE VALUE OF K
526
530
IS DURATION < 3 MINUTES ?
NO
YES
RESET LONG COUNTER AND SHORT COUNTER
540
INCREMENT SHORT COUNTER
532
IS SHORT COUNTER ≥ 3 ?
NO
YES
534
INCREASE THE VALUE OF K
536
LEARN NEW K VALUE
550
ADJUST DTINIT LINE BASED ON NEW K VALUE
560
LEARN NEW DTINIT LINE
570

DEFROST LEARNING ALGORITHM BASED ON TIME OF DEFROST STATE OPERATION

CROSS-REFERENCE TO RELATED APPLICATIONS

The present application claims priority under 35 U.S.C. 119(e) to U.S. Provisional Patent Application No. 62/116,187 filed on Feb. 13, 2015 by Darryl E. Denton, and entitled "Defrost Learning Algorithm Based On Time of Defrost State Operation," the disclosure of which is hereby incorporated by reference in its entirety.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Heating, ventilation, and/or air conditioning (HVAC) systems may generally be used in residential and/or commercial areas for heating and/or cooling to create comfortable temperatures inside those areas. Some HVAC systems may be heat pump systems. Heat pump systems may generally be capable of cooling a comfort zone by operating in a cooling mode for transferring heat from a comfort zone to an ambient zone using a refrigeration cycle and also generally capable of reversing the direction of refrigerant flow through the components of the HVAC system so that heat is transferred from the ambient zone to the comfort zone, thereby heating the comfort zone. When a heat pump system is operated in cold ambient temperatures, condensation may often form on an outdoor condenser coil and freeze. Accordingly, it may be necessary to periodically defrost the outdoor condenser coil. Current methods used to defrost the outdoor condenser coil typically involve reversing the operation of the heat pump system to operate in a cooling mode so that heated refrigerant is delivered to the condenser coil to defrost it. Reversing the operation of the heat pump system may cause damage, stress, and excessive wear on the components of the heat pump system, may reduce the efficiency of the heat pump system, and may require the use of backup heat sources to provide heat to an indoor climate-controlled area when a defrost procedure is not properly timed.

SUMMARY

In some embodiments of the disclosure, a heating, ventilation, and/or air conditioning (HVAC) system is disclosed as comprising: HVAC system, comprising: an outdoor heat exchanger; a refrigeration coil temperature sensor configured to monitor the temperature of the outdoor heat exchanger; an ambient outdoor temperature sensor configured to monitor the ambient outdoor temperature; and a controller configured to: monitor the refrigeration coil temperature sensor and the ambient outdoor temperature sensor; calculate an Actual Coil Delta Temperature (ACDT); compare the calculated ACDT to an Initiate Delta Temperature (DTINIT) associated with the measured ambient outdoor temperature; initiate a defrost procedure in response to the calculated ACDT being greater than or equal to the DTINIT; determine if the duration of the defrost procedure is within a predetermined time threshold; and adjust the duration of a next defrost procedure in response to determining that a predetermined number of consecutive defrost procedures have occurred outside of the predetermined time threshold.

In other embodiments of the disclosure, a method is disclosed as comprising: monitoring the ambient outdoor temperature and the refrigeration coil temperature; calculating an Actual Coil Delta Temperature (ACDT); comparing the calculated ACDT to an Initiate Delta Temperature (DTINIT) associated with the measured ambient outdoor temperature; initiating a defrost procedure in response to the calculated ACDT being greater than or equal to the DTINIT; determining if the duration of the defrost procedure is within a predetermined time threshold; and adjusting the duration of a next defrost procedure in response to determining that a predetermined number of consecutive defrost procedures have occurred outside of the predetermined time threshold.

BRIEF DESCRIPTION OF THE DRAWINGS

For a more complete understanding of the present disclosure and the advantages thereof, reference is now made to the following brief description, taken in connection with the accompanying drawings and detailed description:

FIG. 7 is a flowchart of a method of operating an HVAC system to learn a defrost algorithm according to an embodiment of the disclosure;

DETAILED DESCRIPTION

Figure 1:
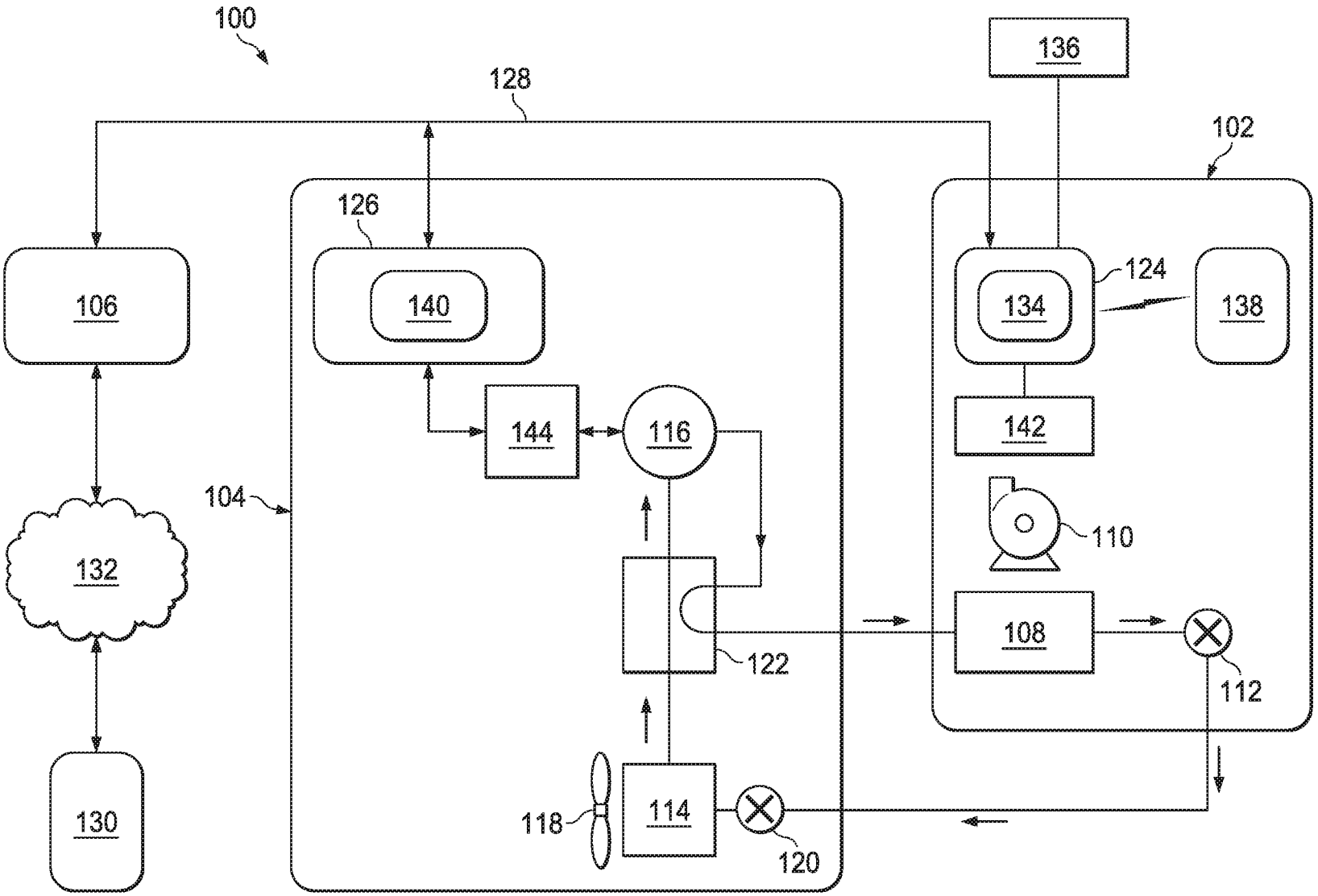
FIG. 1 is a schematic diagram of an HVAC system according to an embodiment of the disclosure.

Referring now to FIG. 1, a schematic diagram of an HVAC system 100 is shown according to an embodiment of the disclosure. Most generally, HVAC system 100 comprises a heat pump system that may be selectively operated to implement one or more substantially closed thermodynamic refrigeration cycles to provide a cooling functionality (hereinafter, "cooling mode") and/or a heating functionality (hereinafter, "heating mode"). The HVAC system 100, configured as a heat pump system, generally comprises an indoor unit 102, an outdoor unit 104, and a system controller 106 that may generally control operation of the indoor unit 102 and/or the outdoor unit 104.

Indoor unit 102 generally comprises an indoor heat exchanger 108, an indoor fan 110, an indoor metering device 112, and an indoor controller 124. The indoor heat exchanger 108 may generally be configured to promote heat exchange between refrigerant carried within internal tubing of the indoor heat exchanger 108 and an airflow that may contact the indoor heat exchanger 108 but that is segregated from the refrigerant. In some embodiments, indoor heat exchanger 108 may comprise a plate-fin heat exchanger. However, in other embodiments, indoor heat exchanger 108 may comprise a spine fin heat exchanger, a microchannel heat exchanger, or any other suitable type of heat exchanger.

The indoor fan 110 may generally comprise a centrifugal blower comprising a blower housing, a blower impeller at least partially disposed within the blower housing, and a blower motor configured to selectively rotate the blower impeller. The indoor fan 110 may generally be configured to provide airflow through the indoor unit 102 and/or the indoor heat exchanger 108 to promote heat transfer between the airflow and a refrigerant flowing through the indoor heat exchanger 108. The indoor fan 110 may also be configured to deliver temperature-conditioned air from the indoor unit 102 to one or more areas and/or zones of a climate controlled structure. The indoor fan 110 may generally comprise a mixed-flow fan and/or any other suitable type of fan. The indoor fan 110 may generally be configured as a modulating and/or variable speed fan capable of being operated at many speeds over one or more ranges of speeds. In other embodiments, the indoor fan 110 may be configured as a multiple speed fan capable of being operated at a plurality of operating speeds by selectively electrically powering different ones of multiple electromagnetic windings of a motor of the indoor fan 110. In yet other embodiments, however, the indoor fan 110 may be a single speed fan.

The indoor metering device 112 may generally comprise an electronically-controlled motor-driven electronic expansion valve (EEV). In some embodiments, however, the indoor metering device 112 may comprise a thermostatic expansion valve, a capillary tube assembly, and/or any other suitable metering device. In some embodiments, while the indoor metering device 112 may be configured to meter the volume and/or flow rate of refrigerant through the indoor metering device 112, the indoor metering device 112 may also comprise and/or be associated with a refrigerant check valve and/or refrigerant bypass configuration when the direction of refrigerant flow through the indoor metering device 112 is such that the indoor metering device 112 is not intended to meter or otherwise substantially restrict flow of the refrigerant through the indoor metering device 112.

Outdoor unit 104 generally comprises an outdoor heat exchanger 114, a compressor 116, an outdoor fan 118, an outdoor metering device 120, a reversing valve 122, and an outdoor controller 126. In some embodiments, the outdoor unit 104 may also comprise a plurality of temperature sensors for measuring the temperature of the outdoor heat exchanger 114, the compressor 116, and/or the outdoor ambient temperature. The outdoor heat exchanger 114 may generally be configured to promote heat transfer between a refrigerant carried within internal passages of the outdoor heat exchanger 114 and an airflow that contacts the outdoor heat exchanger 114 but that is segregated from the refrigerant. In some embodiments, outdoor heat exchanger 114 may comprise a plate-fin heat exchanger. However, in other embodiments, outdoor heat exchanger 114 may comprise a spine-fin heat exchanger, a microchannel heat exchanger, or any other suitable type of heat exchanger.

The compressor 116 may generally comprise a variable speed scroll-type compressor that may generally be configured to selectively pump refrigerant at a plurality of mass flow rates through the indoor unit 102, the outdoor unit 104, and/or between the indoor unit 102 and the outdoor unit 104. In some embodiments, the compressor 116 may comprise a rotary type compressor configured to selectively pump refrigerant at a plurality of mass flow rates. In alternative embodiments, however, the compressor 116 may comprise a modulating compressor that is capable of operation over a plurality of speed ranges, a reciprocating-type compressor, a single speed compressor, and/or any other suitable refrigerant compressor and/or refrigerant pump. In some embodiments, the compressor 116 may be controlled by a compressor drive controller 144, also referred to as a compressor drive and/or a compressor drive system.

The outdoor fan 118 may generally comprise an axial fan comprising a fan blade assembly and fan motor configured to selectively rotate the fan blade assembly. The outdoor fan 118 may generally be configured to provide airflow through the outdoor unit 104 and/or the outdoor heat exchanger 114 to promote heat transfer between the airflow and a refrigerant flowing through the indoor heat exchanger 108. The outdoor fan 118 may generally be configured as a modulating and/or variable speed fan capable of being operated at a plurality of speeds over a plurality of speed ranges. In other embodiments, the outdoor fan 118 may comprise a mixed-flow fan, a centrifugal blower, and/or any other suitable type of fan and/or blower, such as a multiple speed fan capable of being operated at a plurality of operating speeds by selectively electrically powering different multiple electromagnetic windings of a motor of the outdoor fan 118. In yet other embodiments, the outdoor fan 118 may be a single speed fan. Further, in other embodiments, however, the outdoor fan 118 may comprise a mixed-flow fan, a centrifugal blower, and/or any other suitable type of fan and/or blower.

The outdoor metering device 120 may generally comprise a thermostatic expansion valve. In some embodiments, however, the outdoor metering device 120 may comprise an electronically-controlled motor driven EEV similar to indoor metering device 112, a capillary tube assembly, and/or any other suitable metering device. In some embodiments, while the outdoor metering device 120 may be configured to meter the volume and/or flow rate of refrigerant through the outdoor metering device 120, the outdoor metering device 120 may also comprise and/or be associated with a refrigerant check valve and/or refrigerant bypass configuration when the direction of refrigerant flow through the outdoor metering device 120 is such that the outdoor metering device 120 is not intended to meter or otherwise substantially restrict flow of the refrigerant through the outdoor metering device 120.

The reversing valve 122 may generally comprise a four-way reversing valve. The reversing valve 122 may also comprise an electrical solenoid, relay, and/or other device configured to selectively move a component of the reversing valve 122 between operational positions to alter the flowpath of refrigerant through the reversing valve 122 and consequently the HVAC system 100. Additionally, the reversing valve 122 may also be selectively controlled by the system controller 106 and/or an outdoor controller 126.

The system controller 106 may generally be configured to selectively communicate with an indoor controller 124 of the indoor unit 102, an outdoor controller 126 of the outdoor unit 104 and/or other components of the HVAC system 100. In some embodiments, the system controller 106 may be configured to control operation of the indoor unit 102 and/or the outdoor unit 104. In some embodiments, the system controller 106 may be configured to monitor and/or communicate with a plurality of temperature sensors associated with components of the indoor unit 102, the outdoor unit 104, and/or the ambient outdoor temperature. Additionally, in some embodiments, the system controller 106 may comprise a temperature sensor and/or may further be configured to control heating and/or cooling of zones associated with the HVAC system 100. In other embodiments, however, the system controller 106 may be configured as a thermostat for controlling the supply of conditioned air to zones associated with the HVAC system 100.

The system controller 106 may also generally comprise a touchscreen interface for displaying information and for receiving user inputs. The system controller 106 may display information related to the operation of the HVAC system 100 and may receive user inputs related to operation of the HVAC system 100. However, the system controller 106 may further be operable to display information and receive user inputs tangentially and/or unrelated to operation of the HVAC system 100. In some embodiments, however, the system controller 106 may not comprise a display and may derive all information from inputs from remote sensors and remote configuration tools.

In some embodiments, the system controller 106 may be configured for selective bidirectional communication over a communication bus 128. In some embodiments, portions of the communication bus 128 may comprise a three-wire connection suitable for communicating messages between the system controller 106 and one or more of the HVAC system 100 components configured for interfacing with the communication bus 128. Still further, the system controller 106 may be configured to selectively communicate with HVAC system 100 components and/or any other device 130 via a communication network 132. In some embodiments, the communication network 132 may comprise a telephone network, and the other device 130 may comprise a telephone. In some embodiments, the communication network 132 may comprise the Internet, and the other device 130 may comprise a smartphone and/or other Internet-enabled mobile telecommunication device. In other embodiments, the communication network 132 may also comprise a remote server.

The indoor controller 124 may be carried by the indoor unit 102 and may generally be configured to receive information inputs, transmit information outputs, and/or otherwise communicate with the system controller 106, the outdoor controller 126, and/or any other device 130 via the communication bus 128 and/or any other suitable medium of communication. In some embodiments, the indoor controller 124 may be configured to communicate with an indoor personality module 134 that may comprise information related to the identification and/or operation of the indoor unit 102. In some embodiments, the indoor controller 124 may be configured to receive information related to a speed of the indoor fan 110, transmit a control output to an electric heat relay, transmit information regarding an indoor fan 110 volumetric flow-rate, communicate with and/or otherwise affect control over an air cleaner 136, and communicate with an indoor EEV controller 138. In some embodiments, the indoor controller 124 may be configured to communicate with an indoor fan controller 142 and/or otherwise affect control over operation of the indoor fan 110. In some embodiments, the indoor personality module 134 may comprise information related to the identification and/or operation of the indoor unit 102 and/or a position of the outdoor metering device 120.

The indoor EEV controller 138 may be configured to receive information regarding temperatures and/or pressures of the refrigerant in the indoor unit 102. More specifically, the indoor EEV controller 138 may be configured to receive information regarding temperatures and pressures of refrigerant entering, exiting, and/or within the indoor heat exchanger 108. Further, the indoor EEV controller 138 may be configured to communicate with the indoor metering device 112 and/or otherwise affect control over the indoor metering device 112. The indoor EEV controller 138 may also be configured to communicate with the outdoor metering device 120 and/or otherwise affect control over the outdoor metering device 120.

The outdoor controller 126 may be carried by the outdoor unit 104 and may be configured to receive information inputs, transmit information outputs, and/or otherwise communicate with the system controller 106, the indoor controller 124, and/or any other device via the communication bus 128 and/or any other suitable medium of communication. In some embodiments, the outdoor controller 126 may be configured to communicate with an outdoor personality module 140 that may comprise information related to the identification and/or operation of the outdoor unit 104. In some embodiments, the outdoor controller 126 may be configured to receive information related to an ambient temperature associated with the outdoor unit 104, information related to a temperature of the outdoor heat exchanger 114, and/or information related to refrigerant temperatures and/or pressures of refrigerant entering, exiting, and/or within the outdoor heat exchanger 114 and/or the compressor 116. In some embodiments, the outdoor controller 126 may be configured to transmit information related to monitoring, communicating with, and/or otherwise affecting control over the compressor 116, the outdoor fan 118, a solenoid of the reversing valve 122, a relay associated with adjusting and/or monitoring a refrigerant charge of the HVAC system 100, a position of the indoor metering device 112, and/or a position of the outdoor metering device 120. The outdoor controller 126 may further be configured to communicate with and/or control a compressor drive controller 144 that is configured to electrically power and/or control the compressor 116.

The HVAC system 100 is shown configured for operating in a so-called heating mode in which heat may generally be absorbed by refrigerant at the outdoor heat exchanger 114 and rejected from the refrigerant at the indoor heat exchanger 108. Starting at the compressor 116, the compressor 116 may be operated to compress refrigerant and pump the relatively high temperature and high pressure compressed refrigerant through the reversing valve 122 and to the indoor heat exchanger 108, where the refrigerant may transfer heat to an airflow that is passed through and/or into contact with the indoor heat exchanger 108 by the indoor fan 110. After exiting the indoor heat exchanger 108, the refrigerant may flow through and/or bypass the indoor metering device 112, such that refrigerant flow is not substantially restricted by the indoor metering device 112. Refrigerant generally exits the indoor metering device 112 and flows to the outdoor metering device 120, which may meter the flow of refrigerant through the outdoor metering device 120, such that the refrigerant downstream of the outdoor metering device 120 is at a lower pressure than the refrigerant upstream of the outdoor metering device 120. From the outdoor metering device 120, the refrigerant may enter the outdoor heat exchanger 114. As the refrigerant is passed through the outdoor heat exchanger 114, heat may be transferred to the refrigerant from an airflow that is passed through and/or into contact with the outdoor heat exchanger 114 by the outdoor fan 118. Refrigerant leaving the outdoor heat exchanger 114 may flow to the reversing valve 122, where the reversing valve 122 may be selectively configured to divert the refrigerant back to the compressor 116, where the refrigeration cycle may begin again.

Alternatively, to operate the HVAC system 100 in a so-called cooling mode, most generally, the roles of the indoor heat exchanger 108 and the outdoor heat exchanger 114 are reversed as compared to their operation in the above-described heating mode. For example, the reversing valve 122 may be controlled to alter the flow path of the refrigerant from the compressor 116 to outdoor heat exchanger 114 first and then to the indoor heat exchanger 108, the indoor metering device 112 may be enabled, and the outdoor metering device 120 may be disabled and/or bypassed. In cooling mode, heat may generally be absorbed by refrigerant at the indoor heat exchanger 108 and rejected by the refrigerant at the outdoor heat exchanger 114. As the refrigerant is passed through the indoor heat exchanger 108, the indoor fan 110 may be operated to move air into contact with the indoor heat exchanger 108, thereby transferring heat to the refrigerant from the air surrounding the indoor heat exchanger 108. Additionally, as refrigerant is passed through the outdoor heat exchanger 114, the outdoor fan 118 may be operated to move air into contact with the outdoor heat exchanger 114, thereby transferring heat from the refrigerant to the air surrounding the outdoor heat exchanger 114. Furthermore, the HVAC system 100 may be operated in the cooling mode in colder climates to transfer heat from the refrigerant to the outdoor heat exchanger 114 in order to melt frozen condensate that has formed on the outer surfaces of the heat exchanger 114. This procedure may be referred to as a defrost procedure.

Figure 2:
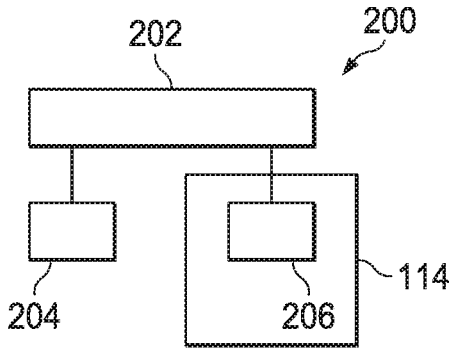
FIG. 2 is a schematic diagram of a control system 200 for learning a defrost procedure according to an embodiment of the disclosure.

Referring now to FIG. 2, a schematic diagram of a control system 200 for learning a defrost procedure is shown according to an embodiment of the disclosure. The control system 200 comprises a controller 202, an ambient outdoor temperature sensor 204, and a refrigeration coil temperature sensor 206. In some embodiments, the controller 202 may generally comprise the system controller 106 of FIG. 1 and be configured to communicate with the outdoor controller 126 and/or monitor the ambient outdoor temperature sensor 204 and the refrigeration coil temperature sensor 206 via the outdoor controller 126. In some embodiments, the controller 202 may comprise system controller 106 of FIG. 1 and be directly coupled to each of the ambient outdoor temperature sensor 204 and the refrigeration coil temperature sensor 206. However, in alternative embodiments, the controller 202 may comprise the outdoor controller 126 of FIG. 1 and be configured to communicate with the system controller 106 of FIG. 1. The controller 202 may generally be configured to monitor, measure, and/or receive temperature value inputs via each of the ambient outdoor temperature sensor 204 and the refrigeration coil temperature sensor 206.

The ambient outdoor temperature sensor 204 is coupled to the controller 202 and configured to monitor and/or measure the ambient outdoor temperature. The ambient outdoor temperature sensor 204 may also be configured to communicate the ambient outdoor temperature to the controller 202. In some embodiments, the ambient outdoor temperature sensor 204 may be carried by the outdoor unit 104 of FIG. 1. However, in alternative embodiments, the ambient outdoor temperature sensor 204 may be remotely mounted from the outdoor unit 104. The refrigeration coil temperature sensor 206 is also coupled to the controller 202. However, the refrigeration coil temperature sensor 206 is configured to monitor and/or measure the refrigeration coil temperature of the outdoor heat exchanger 114 of FIG. 1. The refrigeration coil temperature sensor 206 may also be configured to communicate the refrigeration coil temperature to the controller 202.

In operation, when the HVAC system 100 of FIG. 1 is first operated in a heating mode as previously described herein, the controller 202 may implement a first defrost procedure after operating the HVAC system 100 in the heating mode for a predetermined time period to determine the conditions of the outdoor heat exchanger 114. In some embodiments, the predetermined time period may be about 30 minutes. However, in other embodiments, the predetermined time period may be any other length of time preprogrammed into the controller 202 or alternatively selected by a user via an interface of the controller 202. In some embodiments, the first defrost procedure may be implemented until the refrigeration coil temperature as measured by the refrigeration coil temperature sensor 206 reaches a predetermined temperature. However, in other embodiments, the first defrost procedure may be implemented for a predetermined time period of about 4 minutes, about 5 minutes, and/or about 6 minutes. After the first defrost procedure, the controller 202 may learn and/or select a defrost time of about 4 minutes, about 5 minutes, or about 6 minutes to be used the next defrost procedure as a result a determining the conditions of the outdoor heat exchanger 114.

Upon subsequent defrost procedures, the controller 202 may be configured to implement an algorithm that utilizes the monitored ambient outdoor temperature and the refrigeration coil temperature of temperature sensors 204, 206, respectively, to adjust the defrost procedure to minimize the number of defrost procedures and/or reduce the time that an HVAC system 100 runs in a defrost mode. Accordingly, the controller 202 may be configured to continuously monitor the ambient outdoor temperature via the ambient outdoor temperature sensor 204 and the refrigeration coil temperature of the outdoor heat exchanger 114 via the refrigeration coil temperature sensor 206.

Figure 3:
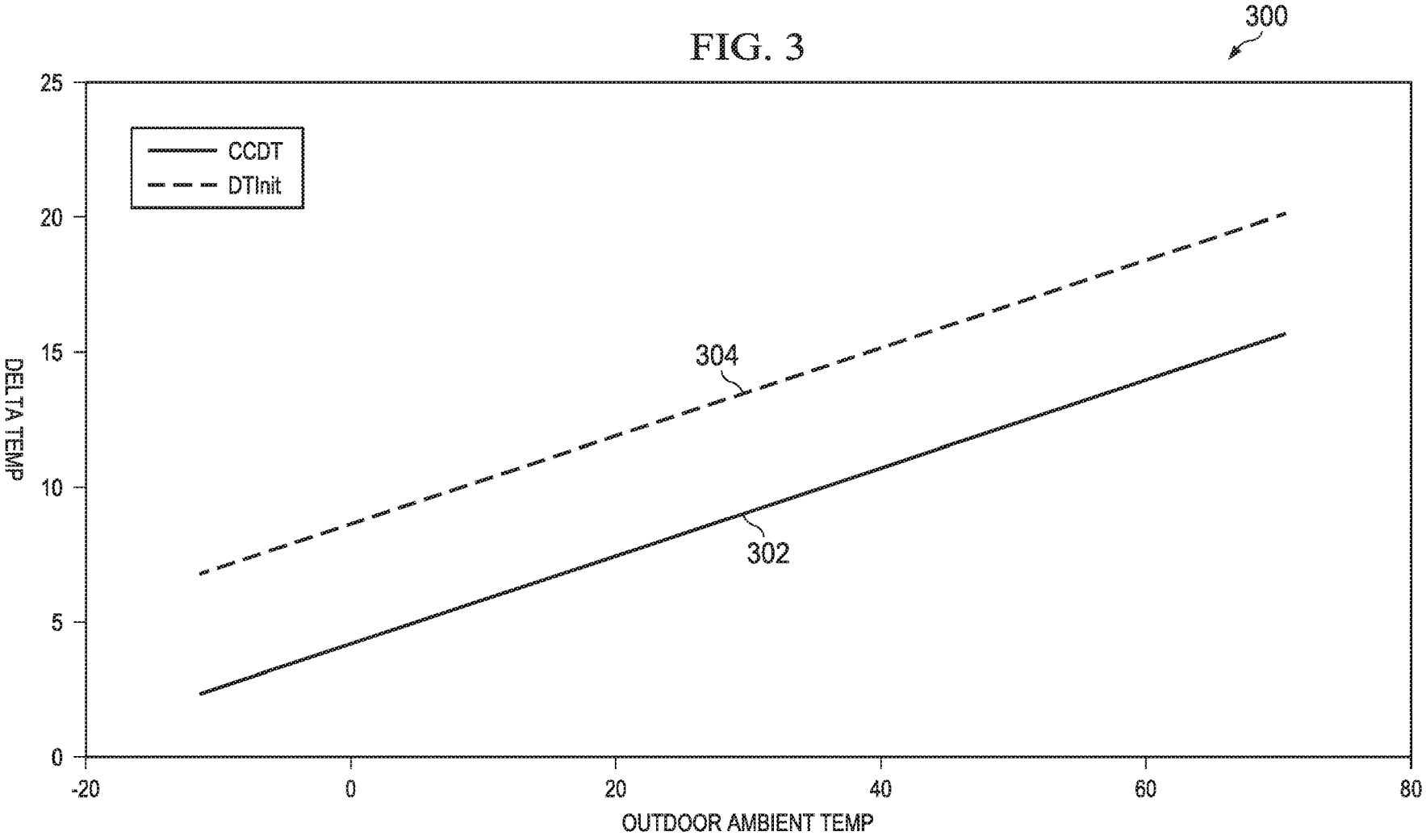
FIG. 3 is an outdoor ambient temperature versus delta temperature chart showing a default Clear Coil Delta Temperature (CCDT) line and a default Initiate Delta Temperature (DTINIT) line according to an embodiment of the disclosure.

Referring now to FIG. 3, an outdoor ambient temperature versus delta temperature chart 300 showing a default Clear Coil Delta Temperature (CCDT) line 302 and a default Initiate Delta Temperature (DTINIT) line 304 are shown according to an embodiment of the disclosure. The chart 300 illustrates the Clear Coil Delta Temperature (CCDT) with respect to ambient outdoor temperature on the default CCDT line 302. The CCDT represents the difference between the refrigeration coil temperature and the ambient temperature measured and averaged for about 3 minutes after the refrigeration coil temperature reaches an equilibrium temperature and/or steady state temperature, which may be after about 12 minutes of continuous operation of the HVAC system 100 in a heating mode after the termination of a defrost procedure. The default CCDT line 302 may generally be represented by the linear equation: $Y=MX+B$, where M is the slope of the line having a default initial value of 0.16, and B is the Y intercept having a default initial value of 4.2. B may also represent the expected CCDT for an ambient outdoor temperature of 0 degrees Fahrenheit.

The chart 300 also illustrates the Initiate Delta Temperature (DTINIT) with respect to ambient outdoor temperature on the default DTINIT line 304. The DTINIT represents the threshold for when a defrost procedure may be initiated when the Actual Coil Delta Temperature (ACDT) exceeds the DTINIT. The ACDT represents the difference between the ambient outdoor temperature and the refrigeration coil temperature at any instantaneous time. The default DTINIT line 304 may generally be represented by the equation Y=MX+KB, where M is the slope of the line having a default initial value of 0.16, B is the Y intercept having a default initial value of 4.2, and K is a constant used to determine the offset value of DTINIT from CCDT having a default initial value of 2.0. As illustrated in chart 300, the default CCDT line 302 and the default DTINIT line 304 represent the initial default values for CCDT and DTINIT with respect to the associated ambient outdoor temperature, respectively, and may be stored within the controller 202.

Referring now to FIGS. 2 and 3, the controller 202 may be configured to implement an algorithm that utilizes the monitored ambient outdoor temperature and the refrigeration coil temperature of temperature sensors 204, 206, respectively, to adjust the defrost procedure to minimize the number of defrost procedures and/or reduce the time that an HVAC system 100 runs in a defrost mode. Accordingly, the controller 202 may be configured to continuously monitor the temperature sensors 204, 206 and repeatedly calculate an Actual Coil Delta Temperature (ACDT), which is the difference in temperature between the ambient outdoor temperature as measured by the ambient outdoor temperature sensor 204 and the refrigeration coil temperature as measured by the refrigeration coil temperature sensor 206 at any given time. The controller 202 may continuously calculate the ACDT and compare the ACDT to the default stored DTINIT line 304 to determine when to initiate a defrost procedure. Accordingly, the controller 202 may initiate a defrost procedure when the ACDT equals and/or exceeds the DTINIT for the measured ambient outdoor temperature.

The controller 202 generally may seek to attain a defrost procedure duration of about 4 minutes. In alternative embodiments, the controller 202 may seek to attain a defrost procedure duration of about 5 minutes, or alternatively, may attempt to attain a shorter or longer defrost procedure duration depending on the HVAC system 100 configuration. When ACDT equals and/or exceeds DTINIT according to the default DTINIT line 304 for a given ambient outdoor temperature, the controller 202 may initiate a defrost procedure and may simultaneously initiate a timer and/or determine the duration of the defrost procedure upon termination of the defrost procedure. The controller 202 may determine if the duration of the defrost procedure is within a specified time threshold. For example, where the controller 202 seeks to attain a 4 minute defrost procedure duration, the time threshold may be +/−1 minute. Accordingly, a defrost procedure duration between 3 minutes and 5 minutes may be deemed to fall within the threshold. However, if a defrost procedure lasts shorter than 3 minutes, the controller 202 may determine that the defrost duration is too short, and if a defrost procedure lasts longer than 5 minutes, the controller 202 may determine that the defrost duration is too long. Accordingly, when the controller 202 determines that there has been 3 consecutive short or long defrosts, the controller 202 may implement an algorithm to adjust the duration of the defrost procedure. More specifically, after three consecutive short or long defrosts, the controller 202 may adjust the value of K of the default DTINIT line 304, which changes the relationship between DTINIT and CCDT.

Figure 4:
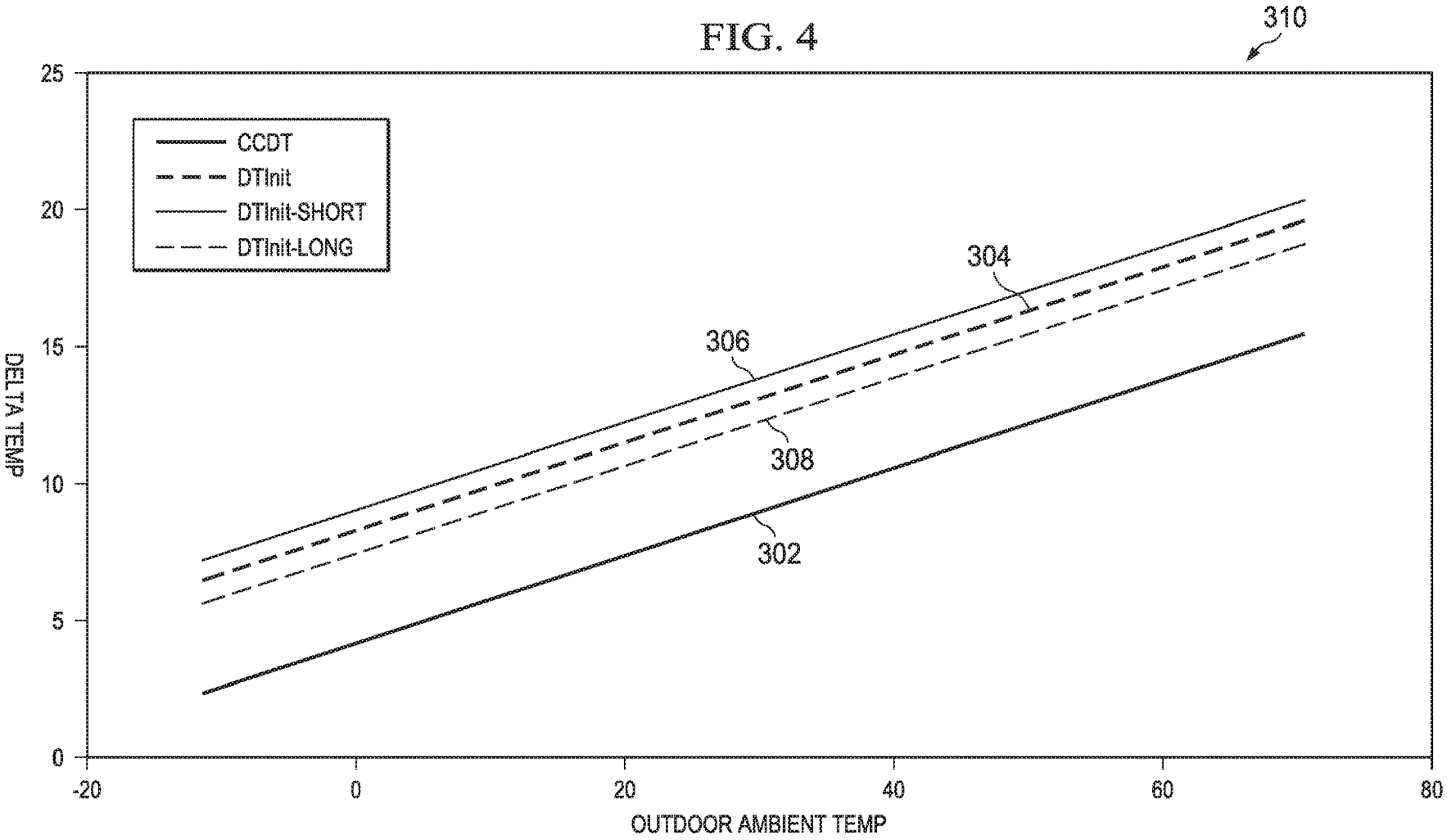
FIG. 4 is an outdoor ambient temperature versus delta temperature chart showing the default CCDT line of FIG. 3, the default DTINIT line of FIG. 3, and two adjusted DTINIT lines according to an embodiment of the disclosure.

Referring now to FIG. 4, an outdoor ambient temperature versus delta temperature chart 310 showing the default CCDT line 302 of FIG. 3, the default DTINIT line 304 of FIG. 3, and two adjusted DTINIT lines 306, 308 are shown according to an embodiment of the disclosure. When the value of K is adjusted, the default DTINIT line 302 may be moved with respect to the default CCDT line 302. A short defrost duration generally indicates that the outdoor heat exchanger 114 is not frosted enough to warrant a defrost procedure. Accordingly, upon three consecutive short defrost procedures, the controller 202 may increase the value of K of the default DTINIT line 302 to separate the default DTINIT line 304 from the default CCDT line 302. DTINIT line 306 represents the new DTINIT line after adjusting the value of K based on three consecutive short defrost procedures. As shown by DTINIT line 306, by increasing the value of K, the DTINIT becomes higher for a given ambient outdoor temperature. Thus, the next defrost will occur later and there will be more frost and/or ice on the outdoor heat exchanger 114, thereby increasing the duration of the defrost procedure.

A long defrost duration generally indicates that the outdoor heat exchanger 114 has accumulated too much frost and/or ice, and that the defrost procedure should have been initiated sooner. Accordingly, upon three consecutive long defrost procedures, the controller 202 may decrease the value of K of the default DTINIT line 302 to bring the default DTINIT line 304 closer to the default CCDT line 302. DTINIT line 308 represents the new DTINIT line after adjusting the value of K based on three consecutive short defrost procedures. As shown by DTINIT line 308, by decreasing the value of K, the DTINIT becomes lower for a given ambient outdoor temperature. Thus, the next defrost will occur sooner and there will be more frost and/or ice on the outdoor heat exchanger 114, thereby decreasing the duration of the defrost procedure.

If there are neither three consecutive short nor long defrost procedures, the controller 202 will not adjust the value of K. While the value of K is adjusted after three consecutive short or long defrost procedures, it will be appreciated that in some embodiments, the value of K may be adjusted after more or less consecutive short or long defrost procedures. Additionally, after three consecutive short or long defrost procedures, the controller 202 may adjust the value of K by about 10%. However, in other embodiments, the value of K may be adjusted by about 5%, about 15%, and/or about 20%. Furthermore, each time the value of K is adjusted, the controller 202 learns the new value of K and the new adjusted DTINIT line, which will be stored and/or used by the controller 202 in conjunction with an instantaneous ACDT to determine when consecutive defrost procedures may be initiated.

Additionally, in some embodiments where the HVAC system 100 comprises a variable speed compressor 116, the controller 202 may be configured to implement the same algorithm to adjust the duration of a defrost procedure. However, the controller may store two DTINIT lines, a DTINIT-HI line for high speed operation and a DTINIT-LO line for low speed operation. Furthermore, in some embodiments comprising a variable speed compressor 116, the controller 202 may monitor the duration of the defrost time and only adjust CCDT up or down by 1 degree after three consecutive short or long defrost procedures.

Figure 5:
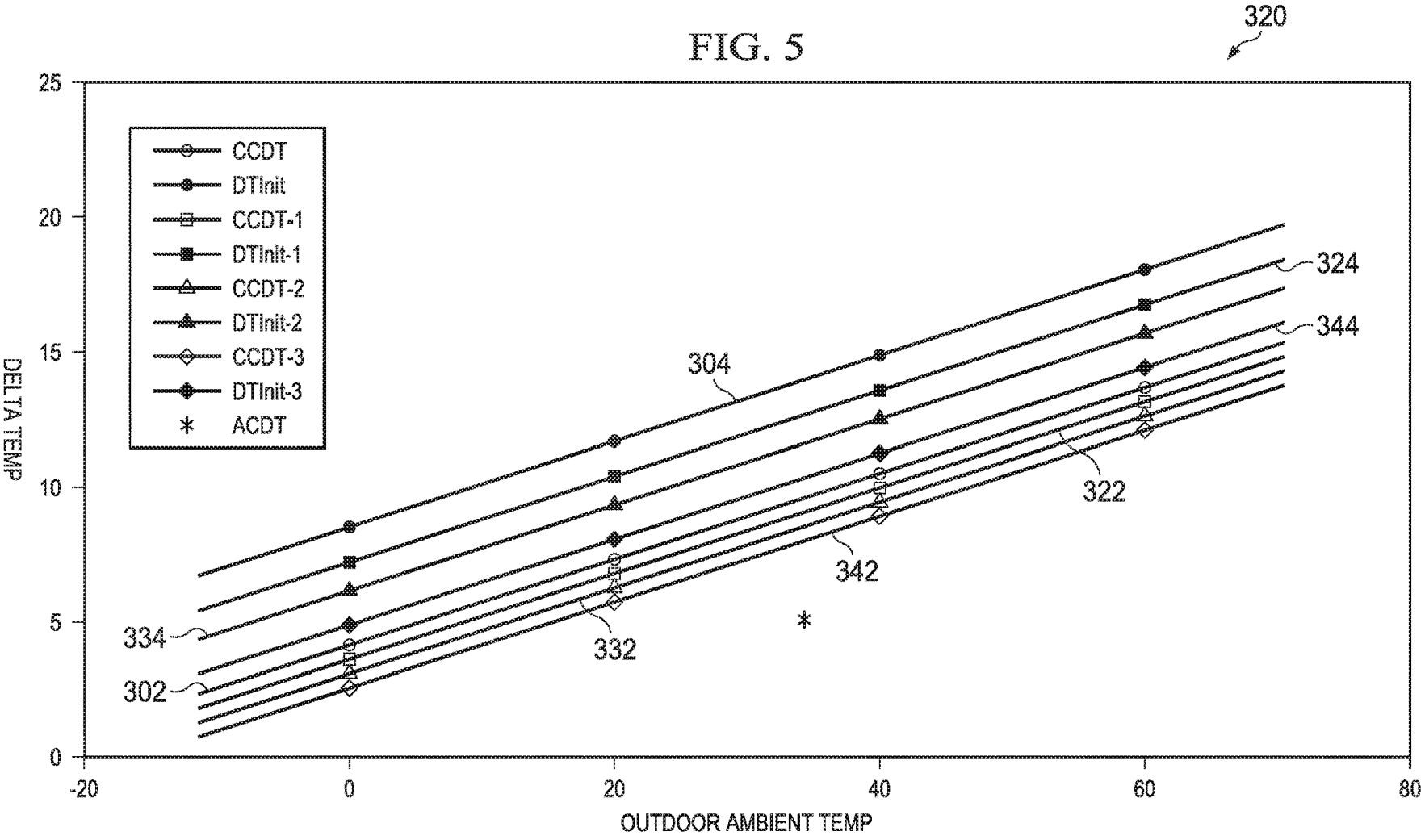
FIG. 5 is an outdoor ambient temperature versus delta temperature chart showing the default CCDT line of FIG. 3, the default DTINIT line of FIG. 3, three adjusted CCDT lines and three adjusted DTINIT lines according to an embodiment of the disclosure.

Referring now to FIG. 5, an outdoor ambient temperature versus delta temperature chart 320 showing the default CCDT line 302 of FIG. 3, the default DTINIT line 304 of FIG. 3, three adjusted CCDT lines 322, 332, 342 and three adjusted DTINIT lines 324, 334, 344 are shown according to an embodiment of the disclosure. In addition to adjusting K, the controller 202 may also be configured adjust the value of B and learn a new B value in order to further approximate the CCDT. Once the ACDT is determined, the controller 202 may determine if the ACDT is different than the CCDT estimated by the default CCDT line 302. If ACDT is different than CCDT, then the value of B may be adjusted by one-eighth of the difference between the ACDT and estimated CCDT for a given measured outdoor ambient temperature. For example, in FIG. 5, the measured ACDT is about 5 degrees Fahrenheit for a measured outdoor ambient temperature of about 35 degrees Fahrenheit, while the estimated CCDT of the default CCDT line 302 is about 9.8 degrees, as determined by Y=MX+B (where Y=(0.16)(35)+4.2=9.8). Thus, the value of B may be adjusted by about one-eighth (⅛) of the difference between the ACDT of 5 degrees and the estimated CCDT of 9.8 degrees. Accordingly, the value of B (default of 4.2) may be adjusted by −0.6 as determined by (0.125(5−9.8)=−0.6. Thus, the new B value will be 3.6.

The controller 202 may thus learn the new value of B and adjust the CCDT line as shown by CCDT line 322. A new DTINIT line 324 may also be calculated. Thus, the adjusted CCDT line 322 and the corresponding adjusted DTINIT line 324 may move closer in relation to the measured ACDT. After subsequent defrost procedures, a new ACDT may be calculated and B may further be adjusted when ACDT is not equal to the estimated CCDT value, as depicted by CCDT lines 332, 342 and corresponding respective DTINIT lines 334, 344. Accordingly, the controller 202 may continuously learn a new value of B and also learn new CCDT lines 322, 332, 342 and corresponding respective DTINIT lines 324, 334, 344. While in this embodiment, the value of B is adjusted by multiplying by about one-eighth (⅛), in other embodiments, the value of B may be alternatively adjusted by any value less than 1. For example, the value of B may be adjusted by multiplying by about ⅙, about ¼, about ⅓, about ⅜, about ½, about ⅝, about ⅔, about ¾, about ⅚, about ⅞, and/or about any other value between zero and 1.

Figure 6:
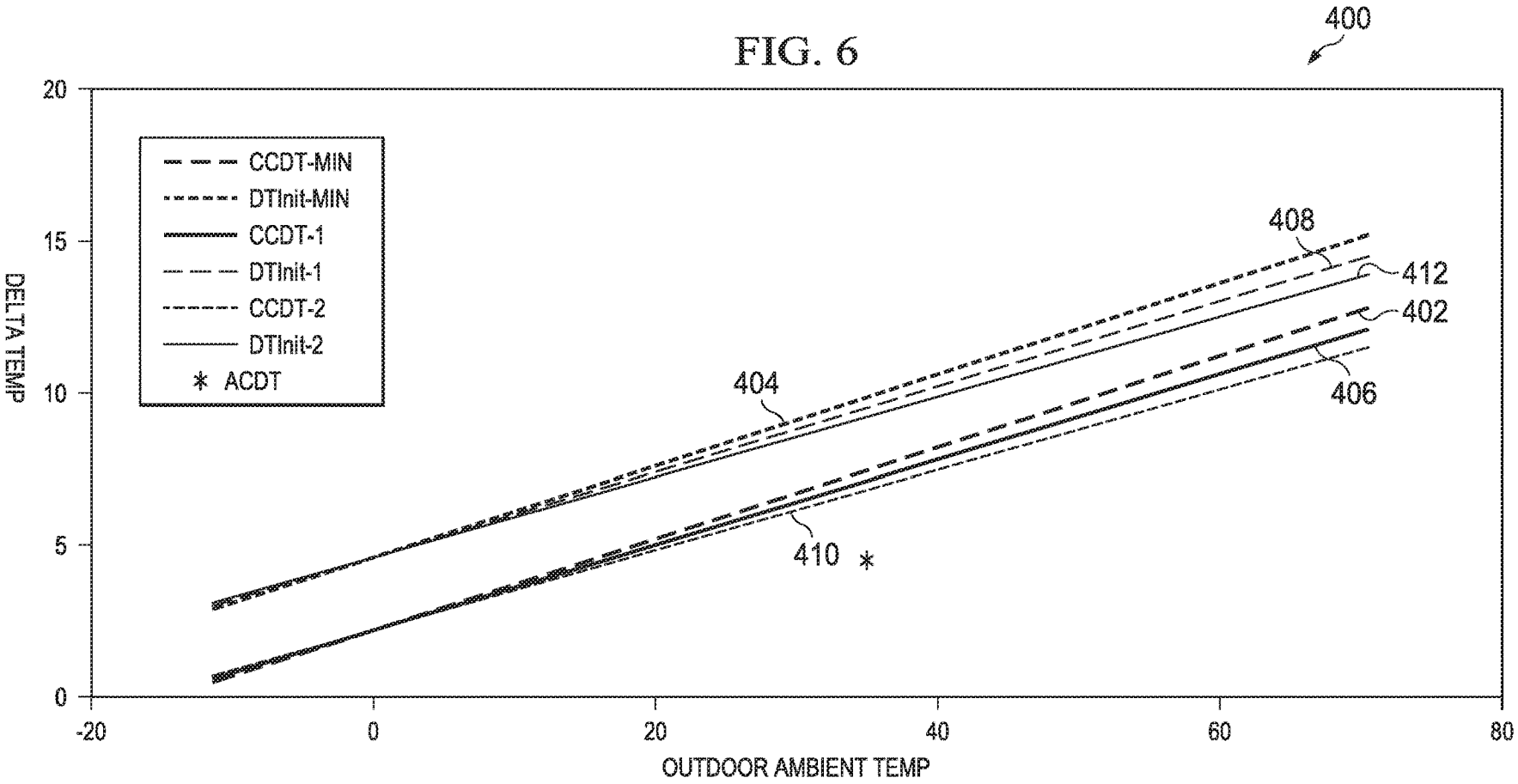
FIG. 6 is an outdoor ambient temperature versus delta temperature chart showing a minimum CCDT line, a minimum DTINIT line, two adjusted CCDT lines, and two adjusted DTINIT lines are shown according to an embodiment of the disclosure.

Referring now to FIG. 6, an outdoor ambient temperature versus delta temperature chart 400 showing a minimum CCDT line 402, a minimum DTINIT line 404, two adjusted CCDT lines 406, 410, and two adjusted DTINIT lines 408, 412 are shown according to an embodiment of the disclosure. In addition to adjusting K and B, the controller 202 may also be configured to adjust the value of the slope, M and be further configured to learn the new value of M for subsequent defrost procedures when the value of B is either at a minimum or a maximum. For example, in FIG. 6, B is depicted stuck at a minimum value. When B is at a minimum value, the value of M may be reduced to bring the CCDT line 402 closer to the measured ACDT value. However, when B is at a maximum value, the value of M may be increased to bring the CCDT line 402 away from the measured ACDT. For example, in FIG. 6, the measured ACDT is about 5 degrees Fahrenheit for a measured outdoor ambient temperature of about 35 degrees Fahrenheit, while the estimated CCDT of the default CCDT line 302 is about 9.8 degrees, as determined by Y=MX+B (where Y=(0.16)(35)+4.2=9.8). Thus, the value of the slope, M, may be adjusted by the same ratio as the B value is adjusted (in this example, ⅛). Thus the value of M may be determined by the equation: $M_{New}$=⅛(ACDT−B)/($T_{amb}$−0)+⅞(M), where B is the minimum or maximum value and $T_{amb}$ is the measured ambient outdoor temperature. Accordingly, $M_{New}$ will be about 0.149 as determined by FIG. 6 where $M_{New}$=⅛(5−2.5)/(35)+⅞(0.16)=0.149.

CCDT line 406 and the corresponding DTINIT line 408 represent the new lines after the value of M has been reduced ($M_{New}$) following a defrost procedure, and CCDT line 410 and the corresponding DTINIT line 412 represent after M has been adjusted a second time following a subsequent defrost procedure. Accordingly, the controller 202 may continuously learn a new value of M and also learn new CCDT lines 406, 410 and corresponding respective DTINIT lines 408, 412. While in this embodiment, the value of M is adjusted by multiplying by about one-eighth (⅛), in other embodiments, the value of M may be alternatively adjusted by any value less than 1. For example, the value of M may be adjusted by multiplying by about ⅙, about ¼, about ⅓, about ⅜, about ½, about ⅝, about ⅔, about ¾, about ⅚, about ⅞, and/or about any other value between zero and 1. Collectively, it will be appreciated that the controller 202 and/or the algorithm employed by the controller 202 may continuously adjust the values of K, B, and M and learn the new values of K, B, and M to estimate the CCDT for an HVAC system, such as HVAC system 100.

Referring now to FIG. 7, a flowchart of a method 500 of operating an HVAC system to learn a defrost algorithm is shown according to an embodiment of the disclosure. The method 500 may begin at block 502 by monitoring the ambient outdoor temperature and the refrigeration coil temperature. The method 500 may continue at block 504 by determining the Actual Coil Delta Temperature (ACDT), which is the difference between the ambient outdoor temperature and the refrigeration coil temperature. The method 500 may continue at block 506 by determining if the ACDT is greater than or equal to the Initiate Delta Temperature (DTINIT) for the measured ambient outdoor temperature. If ACDT<DTINIT for the measured ambient outdoor temperature, the method 500 may return to block 502. If ACDT≥DTINIT, the method 500 may continue at block 508 by initiating a defrost procedure. The method 500 may continue at block 510 by determining the duration of the defrost procedure at the termination of the defrost procedure. The method 500 may continue at block 520 by determining if the duration of the defrost procedure is greater than 5 minutes. If the duration of the defrost procedure is greater than 5 minutes, the method 500 may continue at block 522 by incrementing a long counter. If the duration of the defrost procedure is less than 5 minutes then the method 500 may continue at block 530 by determining if the duration of the defrost procedure is less than 3 minutes. If the duration of the defrost procedure is less than 3 minutes, the method 500 may continue at block 532 by incrementing a short counter. If the defrost procedure is greater than 3 minutes, then the method 500 may continue at block 540 by resetting each of the long counter and the short counter to zero.

At block 522, after incrementing the long counter, the method 500 may continue at block 524 by determining if the long counter is greater than or equal to 3. If the long counter is greater than or equal to 3, the method 500 may continue at block 526 by decreasing the value of K. In some embodiments, the value of K may be reduced by about 10%. If the long counter is less than 3, the method 500 may return to block 502. At block 526, after decreasing the value of K, the method 500 may continue at block 550 by learning the new value of K. In some embodiments, the new value of K may be learned by the controller 202. The method 500 may continue at block 560 by adjusting the DTINIT line based on the new K value. The method 500 may continue at block 570 by learning the new DTINIT line. In some embodiments, the new DTINIT line may be learned by the controller 202. The method 500 may then restart by returning to block 502.

At block 532, after incrementing the short counter, the method 500 may continue at block 534 by determining if the short counter is greater than or equal to 3. If the short counter is greater than or equal to 3, the method 500 may continue at block 536 by increasing the value of K. In some embodiments, the value of K may be increased by about 10%. If the short counter is less than 3, the method 500 may return to block 502. At block 536, after decreasing the value of K, the method 500 may continue at block 550 by learning the new value of K. In some embodiments, the new value of K may be learned by the controller 202. The method 500 may continue at block 560 by adjusting the DTINIT line based on the new K value. The method 500 may continue at block 570 by learning the new DTINIT line. In some embodiments, the new DTINIT line may be learned by the controller 202. The method 500 may then restart by returning to block 502.

Figure 8:
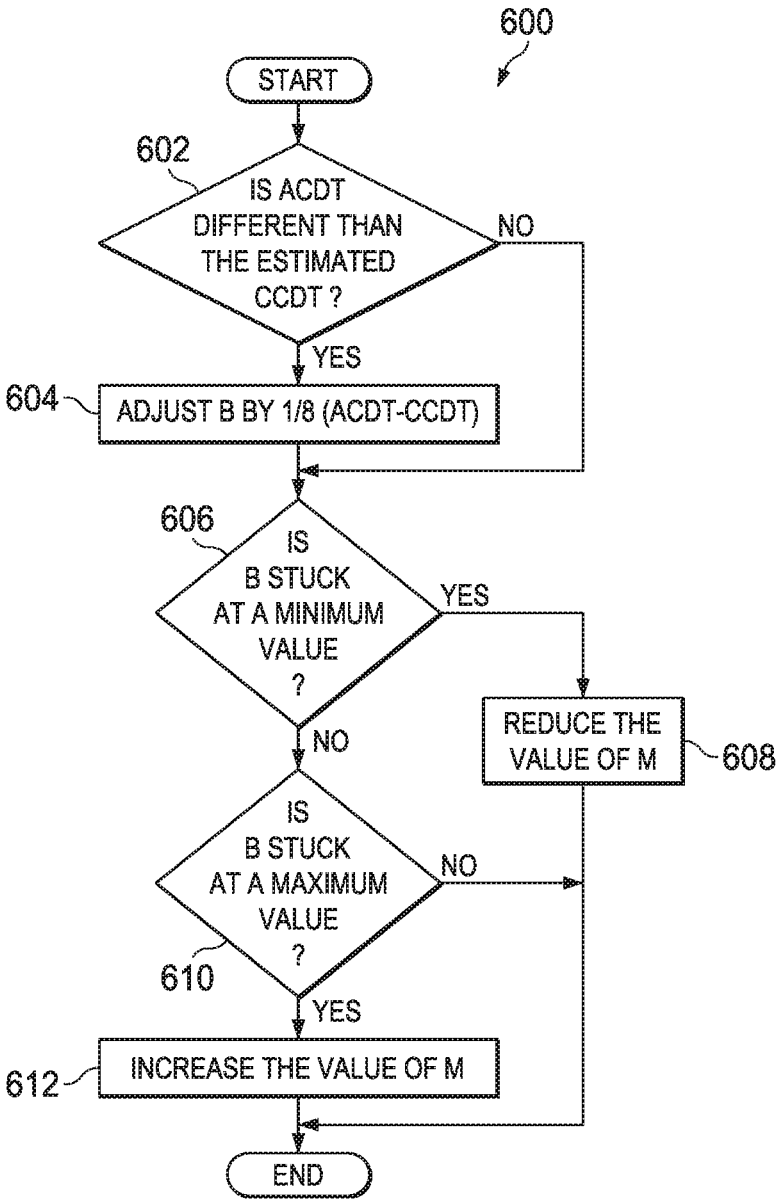
FIG. 8 is a flowchart of a method of operating an HVAC system to learn a defrost algorithm according to an embodiment of the disclosure.

Referring now to FIG. 8, a flowchart of a method 600 of operating an HVAC system to learn a defrost algorithm is shown according to an embodiment of the disclosure. The method 600 may begin at block 602 by determining whether the ACDT is different than the estimated CCDT. In some embodiments, this may be accomplished by comparing a CCDT line stored in the controller 202 to the measured ACDT for a measured ambient outdoor temperature. If the ACDT is different than the estimated CCDT, the method 600 may continue at block 604 by adjusting B by one-eighth of the difference between the ACDT and the estimated CCDT and proceed to block 606. If the ACDT is not different than the estimated CCDT at block 602, the method 600 may continue to block 606. At block 606, the controller 202 may determine if B is stuck at a minimum value. If B is stuck at a minimum value, the method 600 may conclude at block 608 by reducing the value of M. If B is not stuck at a minimum value at block 606, the method 600 may continue to block 610. At block 610, the controller 202 may determine if B is stuck at a maximum value. If B is stuck at a maximum value, the method may conclude at block 612 by increasing the value of M. If B is not stuck at a maximum value, the method may conclude. It will be appreciated that the method 600 may be a part of method 500 of FIG. 7. Accordingly, the method 600 may be inserted between block 504 and block 506 of method 500, where the method 500 proceeds to block 602 after block 504, and the method 600 concludes at block 506.

Figure 9:
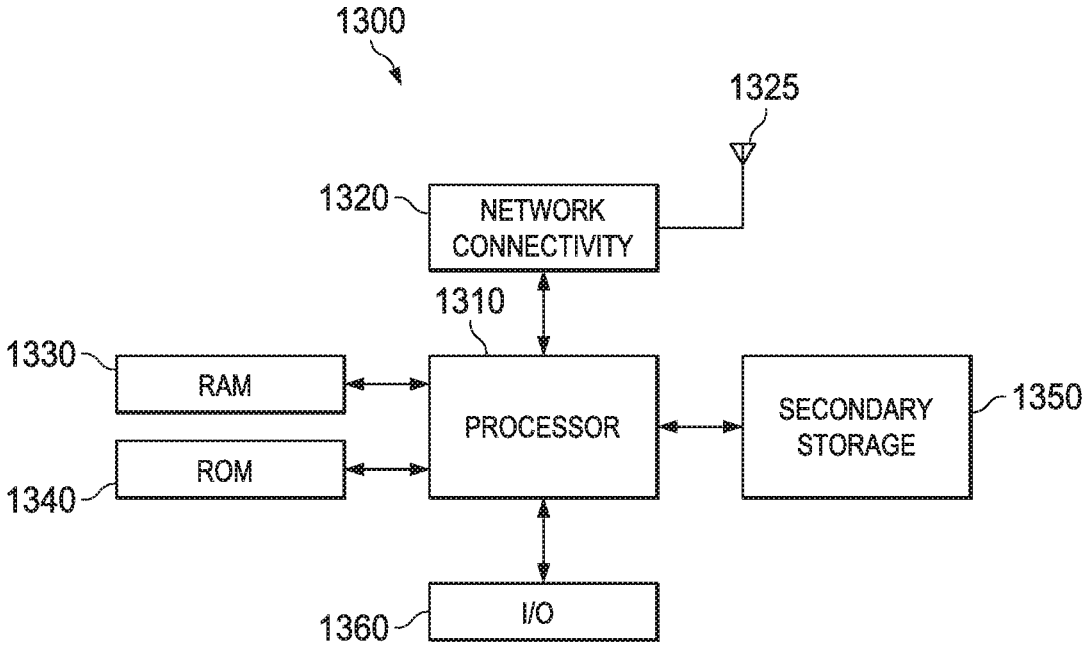
FIG. 9 is a schematic diagram of a general-purpose processor according to an embodiment of the disclosure.

Referring now to FIG. 9, a schematic diagram of a general-purpose processor (e.g., electronic controller or computer) system 1300 is shown according to an embodiment of the disclosure. In some embodiments, processing system 1300 may be system controller 106, outdoor controller 126, and/or controller 202 and be suitable for implementing one or more embodiments disclosed herein. In addition to the processor 1310 (which may be referred to as a central processor unit or CPU), the system 1300 may comprise network connectivity devices 1320, random access memory (RAM) 1330, read only memory (ROM) 1340, secondary storage 1350, and input/output (I/O) devices 1360. In some cases, some of these components may not be present or may be combined in various combinations with one another or with other components not shown. These components may be located in a single physical entity or in more than one physical entity. Any actions described herein as being taken by the processor 1310 might be taken by the processor 1310 alone or by the processor 1310 in conjunction with one or more components of the processor system 1300.

The processor 1310 generally executes algorithms, instructions, codes, computer programs, and/or scripts that it might access from the network connectivity devices 1320, RAM 1330, ROM 1340, or secondary storage 1350 (which might include various disk-based systems such as hard disk, floppy disk, optical disk, or other drive). While only one processor 1310 is shown, processor system 1300 may comprise multiple processors 1310. Thus, while instructions may be discussed as being executed by a processor 1310, the instructions may be executed simultaneously, serially, or otherwise by one or multiple processors 1310. The processor 1310 may be implemented as one or more CPU chips.

The network connectivity devices 1320 may take the form of modems, modem banks, Ethernet devices, universal serial bus (USB) interface devices, serial interfaces, token ring devices, fiber distributed data interface (FDDI) devices, wireless local area network (WLAN) devices, radio transceiver devices such as code division multiple access (CDMA) devices, global system for mobile communications (GSM) radio transceiver devices, worldwide interoperability for microwave access (WiMAX) devices. Bluetooth. CAN (Controller Area Network) and/or other well-known technologies, protocols and standards for connecting to networks. These network connectivity devices 1320 may enable the processor 1310 to communicate with the Internet or one or more telecommunications networks or other networks from which the processor 1310 might receive information or to which the processor 1310 might output information.

The network connectivity devices 1320 might also include one or more transceiver components 1325 capable of transmitting and/or receiving data wirelessly in the form of electromagnetic waves, such as radio frequency signals or microwave frequency signals. Alternatively, the data may propagate in or on the surface of electrical conductors, in coaxial cables, in waveguides, in optical media such as optical fiber, or in other media. The transceiver component 1325 might include separate receiving and transmitting units or a single transceiver. Information transmitted or received by the transceiver component 1325 may include data that has been processed by the processor 1310 or instructions that are to be executed by processor 1310. Such information may be received from and outputted to a network in the form, for example, of a computer data baseband signal or signal embodied in a carrier wave. The data may be ordered according to different sequences as may be desirable for either processing or generating the data or transmitting or receiving the data. The baseband signal, the signal embedded in the carrier wave, or other types of signals currently used or hereafter developed may be referred to as the transmission medium and may be generated according to several methods well-known to one skilled in the art.

The RAM 1330 might be used to store volatile data and perhaps to store instructions that are executed by the processor 1310. The ROM 1340 is a non-volatile memory device that typically has a smaller memory capacity than the memory capacity of the secondary storage 1350. ROM 1340 might be used to store instructions and perhaps data that are read during execution of the instructions. Access to both RAM 1330 and ROM 1340 is typically faster than access to secondary storage 1350. The secondary storage 1350 is typically comprised of one or more disk drives or tape drives and might be used for non-volatile storage of data or as an over-flow data storage device if RAM 1330 is not large enough to hold all working data. Secondary storage 1350 may be used to store programs or instructions that are loaded into RAM 1330 when such programs are selected for execution or information is needed.

The I/O devices 1360 may include liquid crystal displays (LCDs), touch screen displays, keyboards, keypads, switches, dials, mice, track balls, voice recognizers, card readers, paper tape readers, printers, video monitors, transducers, sensors, or other well-known input or output devices. Also, the transceiver component 1325 might be considered to be a component of the I/O devices 1360 instead of or in addition to being a component of the network connectivity devices 1320. Some or all of the I/O devices 1360 may be substantially similar to various components disclosed herein.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Unless otherwise stated, the term "about" shall mean plus or minus 10 percent of the subsequent value. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. A heating, ventilation, and/or air conditioning (HVAC) system, comprising:

an outdoor heat exchanger;

a refrigeration coil temperature sensor configured to monitor a temperature of the outdoor heat exchanger;

an ambient outdoor temperature sensor configured to monitor an ambient outdoor temperature; and a controller configured to:

monitor the refrigeration coil temperature sensor and the ambient outdoor temperature sensor;

calculate an Actual Coil Delta Temperature (ACDT);

compare the calculated ACDT to an Initiate Delta Temperature (DTINIT) associated with a measured ambient outdoor temperature;

initiate a defrost procedure in response to the calculated ACDT being greater than or equal to the DTINIT;

determine if a duration of the defrost procedure is within a predetermined time threshold;

adjust a parameter of a next defrost procedure in response to determining that a predetermined number of consecutive defrost procedures have occurred outside of the predetermined time threshold;

estimate Clear Coil Delta Temperature (CCDT) values for a plurality of outdoor ambient temperatures using a first linear equation: $Y_1=MX+B$, wherein the controller is further configured to estimate DTINIT values for the plurality of outdoor ambient temperatures using a second linear equation: $Y_2=MX+KB$, and wherein $Y_1$ and $Y_2$ are Y-axis coordinates, M is a slope, X is an X-axis coordinate, B is a Y intercept, and K is a constant; and reduce the constant K in response to the controller determining that the predetermined number of consecutive defrost procedures occurred for a longer time than the predetermined time threshold.

2. The HVAC system of claim 1, wherein a default value of M is 0.16, a default value of B is 4.2, and a default value of K is 2.0.

3. The HVAC system of claim 1, wherein the duration of the next defrost procedure is decreased in response to the controller reducing the constant K.

4. The HVAC system of claim 1, wherein the controller is configured to increase the value of K in response to the controller determining that a predetermined number of consecutive defrost procedures occurred for a shorter time than the predetermined time threshold.

5. The HVAC system of claim 4, wherein the duration of the next defrost procedure is increased in response to the controller increasing the value of K.

6. The HVAC system of claim 4, wherein the controller is configured to adjust the value of K by about 10%.

7. The HVAC system of claim 6, wherein the controller is configured to learn an adjusted value of K to adjust an estimate of the DTINIT values associated with the plurality of ambient outdoor temperatures.

8. The HVAC system of claim 1, wherein in response to the ACDT being different than the CCDT for a measured ambient outdoor temperature, the controller is configured to adjust a value of B by a fraction of a difference between the ACDT and the CCDT for a given measured outdoor ambient temperature.

9. The HVAC system of claim 8, wherein in response to the value of B being stuck at a minimum value or a maximum value, the controller is configured to adjust a value of M by determining a new value of M via an equation $M_{New}=\frac{1}{8}(ACDT-B)/(T_{amb}-0)+\frac{7}{8}(M)$, where $T_{amb}$ is the measured ambient outdoor temperature.

10. A heating, ventilation, and/or air conditioning (HVAC) system, comprising:

an outdoor heat exchanger;

a refrigeration coil temperature sensor configured to monitor a temperature of the outdoor heat exchanger;

an ambient outdoor temperature sensor configured to monitor an ambient outdoor temperature; and a controller configured to:

monitor the refrigeration coil temperature sensor and the ambient outdoor temperature sensor;

calculate an Actual Coil Delta Temperature (ACDT);

compare the calculated ACDT to an Initiate Delta Temperature (DTINIT) associated with a measured ambient outdoor temperature;

initiate a defrost procedure in response to the calculated ACDT being greater than or equal to the DTINIT;

determine if a duration of the defrost procedure is within a predetermined time threshold;

adjust a parameter of a next defrost procedure in response to determining that a predetermined number of consecutive defrost procedures have occurred outside of the predetermined time threshold;

estimate Clear Coil Delta Temperature (CCDT) values for a plurality of outdoor ambient temperatures using a first linear equation: Y1=MX+B, wherein the controller is further configured to estimate DTINIT values for the plurality of outdoor ambient temperatures using a second linear equation: Y2=MX+KB, and wherein Y1 and Y2 are Y-axis coordinates, M is a slope, X is an X-axis coordinate, B is a Y intercept, and K is a constant; and wherein in response to a value of B being stuck at a minimum value or a maximum value, the controller is configured to adjust a value of M.

11. The HVAC system of claim 10, wherein the controller is configured to adjust the value of M by determining a new value of M via an equation $M_{New}=\frac{1}{8}(ACDT-B)/(T_{amb}-0)+\frac{7}{8}(M)$, where $T_{amb}$ is the measured ambient outdoor temperature.

12. The HVAC system of claim 11, wherein a default value of M is 0.16, a default value of B is 4.2, and a default value of K is 2.0.

13. The HVAC system of claim 10, wherein the controller is configured to increase the value of K in response to the controller determining that a predetermined number of consecutive defrost procedures occurred for a shorter time than the predetermined time threshold.

14. The HVAC system of claim 13, wherein the duration of the next defrost procedure is increased in response to the controller increasing the value of K.

15. The HVAC system of claim 13, wherein the controller is configured to adjust the value of K by about 10%.

16. The HVAC system of claim 15, wherein the controller is configured to learn an adjusted value of K to adjust an estimate of the DTINIT values associated with the plurality of ambient outdoor temperatures.

17. The HVAC system of claim 13, wherein the controller is configured to reduce the constant K in response to the controller determining that the predetermined number of consecutive defrost procedures occurred for a longer time than the predetermined time threshold.

18. The HVAC system of claim 17, wherein the duration of the next defrost procedure is decreased in response to the controller reducing the constant K.

19. The HVAC system of claim 10, wherein the predetermined time threshold comprises 3 to 5 minutes.

20. The HVAC system of claim 1, wherein the predetermined time threshold comprises 3 to 5 minutes.

* * * * *